United States Patent [19]

Todokoro

[11] 4,118,026

[45] Oct. 3, 1978

[54] GAME BOARD FOR CHILDREN

[76] Inventor: Masatoshi Todokoro, 2-33 Koganehara 2-chome, Matsudo, Chiba-Prefecture, Japan, 270

[21] Appl. No.: 772,775

[22] Filed: Feb. 28, 1977

[51] Int. Cl.[2] ..... A63F 9/00

[52] U.S. Cl. ..... 273/1 R; 273/95 R

[58] Field of Search ..... 273/1 R, 1 E, 1 M, 95 R; 124/16

[56] References Cited

U.S. PATENT DOCUMENTS

| | | | |
|---|---|---|---|
| 3,358,998 | 12/1967 | Goldfarb | 273/95 R |
| 3,391,934 | 7/1968 | Ryan et al. | 124/16 X |
| 3,710,455 | 1/1973 | Liversioge et al. | 273/1 R UX |

*Primary Examiner*—Paul E. Shapiro

*Attorney, Agent, or Firm*—George B. Oujevolk

[57] ABSTRACT

A game board comprising a rotary disc fitted in a base board, said rotary disc having formed in its surface a suitable number of pits in each of which is verticaly and movably fitted a seat plate designed to support thereon a hopping plaything such as a model fish with a spring. When the rotary disc is turned, the lock of the respective seat plates is released in an irregular order at irregular time intervals so that the respective seat plates rise up quickly under spring pressure one after the other in irregular order to let the respective playthings hop up successively. So the players vie in capturing each popped-up plaything with a scoop net or the like.

2 Claims, 7 Drawing Figures

GAME BOARD FOR CHILDREN

BACKGROUND OF THE INVENTION

The present invention relates to games and more particularly to childrens games.

SUMMARY OF THE INVENTION

Generally speaking, the present invention contemplates a game board for use by children, with a base board and a rotary disc fitted in the base board, said rotry disc having irregularly formed therein a suitable number of pits in each of which is placed a seat plate arranged movable vertically under the force of a spring and designed to carry thereon a hopping plaything such as for example a model fish. Before the game is started, each seat plate is pressed down against the spring and locked at its lowermost position. When the rotary disc is turned, the respective seat plates are unlocked in an irregular order at suitable time intervals and rise up quickly under the force of the springs to let the objects carried thereon jump up into the air in succession. So the players vie with each other in capturing each plaything with a scoop net or other means.

Now the invention is described in detail by way of an embodiment thereof in conjunction with the accompanying drawings, in which:

DETAILED DESCRIPTION

Figure 1:
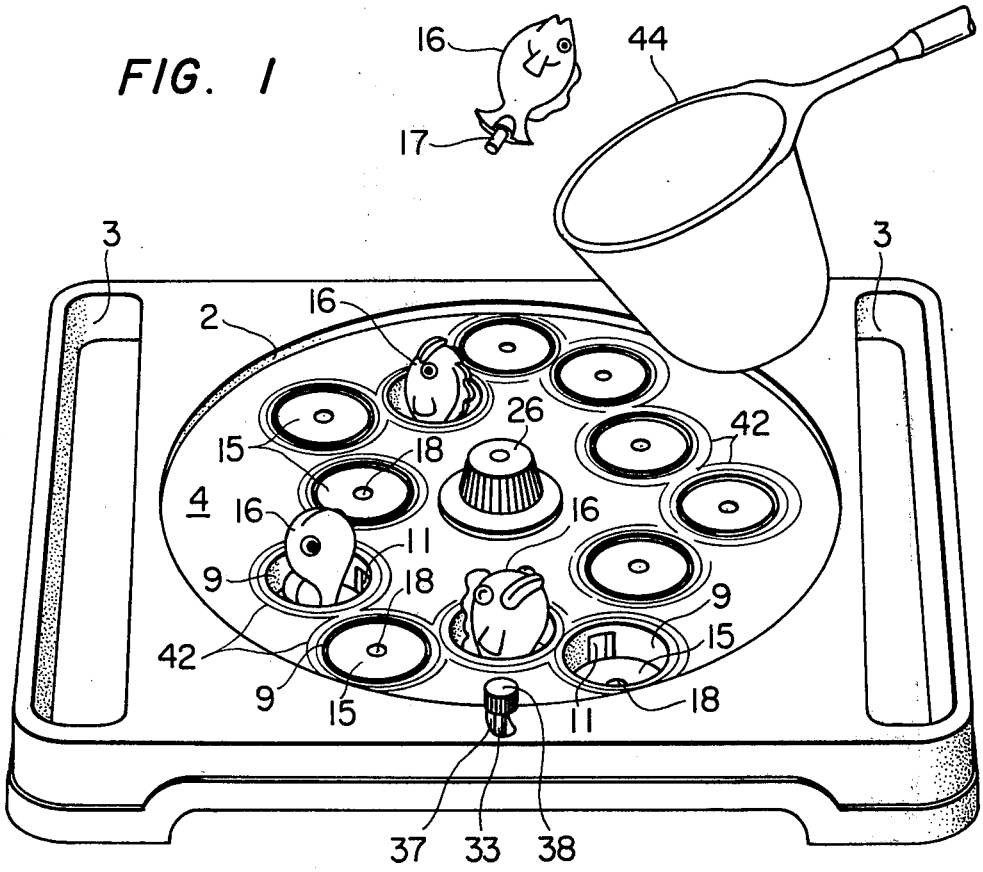
FIG. 1 is a general perspective view of a game board according to this invention as it is shown in a mode of use.
Figure 2:
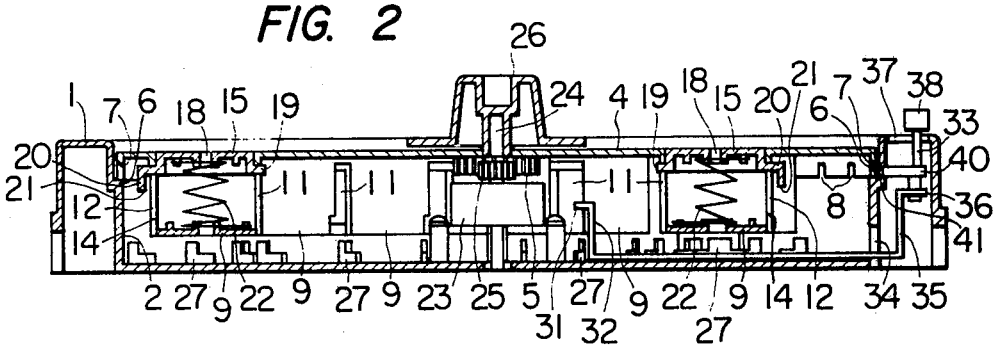
FIG. 2 is a sectional view of the game board shown in FIG. 1.
Figure 3:
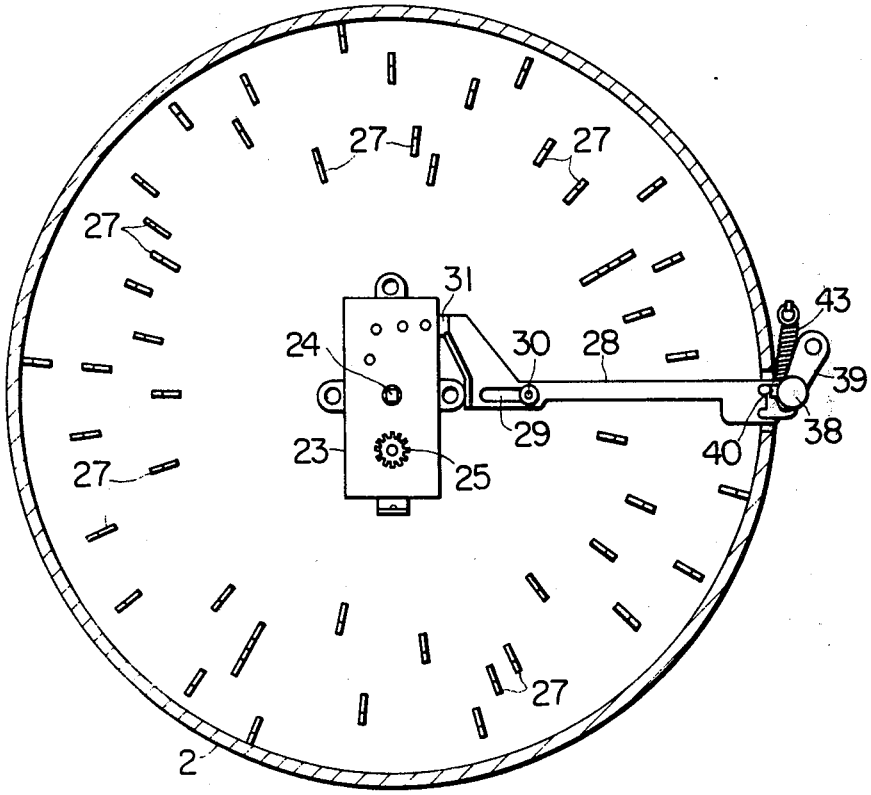
FIG. 3 is a plane view of a recession of the game board in which a rotary disc is to be fitted.

Referring generally to the drawings, reference numeral 1 indicates a base board having a circular recession 2 in its center and elongated gutter-like recessions 3 along both ends thereof. Rotatably fitted in said central recession 2 is a rotary disc 4 which is colored in blue at its surface and has secured to the underside of its central portion a driven gear 5. Along the periphery of said rotary disc 4 is provided a side wall portion 7 which is bent downwardly at right angles, with the edge thereof being received and secured in position by a stepped portion 6 projecting from the inner wall of the recession 2. Said side wall portion 7 is provided with a plurality of equidistantly arranged cutouts 8. The rotary disc 4 is also provided with a plurality (12 in the shown embodiment) of circular pits 9 arranged irregularly relative to each other and at varied distances from the center of the disc. Each of said pits 9 opens at the disc surface and caves in vertically therefrom. Around each of said pits are formed cuts 42 resembling the water rings. It will be also noted that the side wall of each of said pits 9 is formed with a pair of vertical slots 11 and 12, one of such slots 11 being formed at the side wall portion positioned closest to the center of the rotary disc 4 and the other slot 12 being formed at the diametrically opposed portion thereof. The end on one side of the slot 11 and the end on the other side of the slot 12 are cut out at the lower parts, and the corresponding engaging steps 13 and 14 are provided in the respective cut-out portions.

In each of said pits 9 is placed a circular seat plate 15 arranged movable vertically. In the center of said seat plate 15 is formed a hole 18 designed to receive a lobe 17 formed at the lower end of each hopping plaything such as a model fish 16. At the diametrically opposed peripheral parts of each said seat plate 15 are integrally provided the protuberances 19 and 20 which are designed such that they fit into the said vertical slots 11 and 12, respectively, and that when the seat plate 15 is depressed to its lowermost position, said protuberances 19 and 20 will engage with the stepped portions 13 and 14, respectively. At an end of the protuberance 20 engaged in the slot 12 is provided an integral contact piece 21 which projects outside of the pit 9 and is bent downwardly.

A coil spring 22 is disposed between the underside of each seat plate 15 and the inside bottom portion of the associated pit 9, said coil spring 22 being adapted to support the seat plate 15 such that its top surface stays flush with the surface of the rotary disc 4. Said coil spring 22 is also so arranged that when the seat plate 15 held at its lowermost position is unlocked, it is forced to turn in the direction where the protuberances 19, 20 are brought into engagement with the corresponding stepped portions 13, 14.

Supported at the inside bottom of the recession 2 is a frame 23 which has provided therein a spiral spring adapted to accumulate the rotative force when a square shaft 24 extending through the central hole of the driven gear 5 to project above the top surface of the rotary disc 4 is turned in one direction, and a prime mover mechanism comprising reduction gears adapted to transmit the rotative force accumulated in said spiral spring to a driving gear 25 meshed with said driven gear 5 while reducing said rotative force. Exposed above the surface of the rotary disc 4 is a grip 26 which is mounted over the portion of the square shaft 24 projecting out from the central part of the upper surface of the rotary disc 4. On the inside bottom surface of the recession 2 are provided a plurality of protuberances 27 arranged irregularly within the area where the contact pieces 21 of the engaging protuberances 20 of the respective seat plates 15 locked at their lowermost positions move with rotation of the rotary disc 4. When a contact piece 21 hits against any of these protuberances 27, the associated engaging protuberances 19, 20 are disengaged from the corresponding stepped portions 13, 14.

There is also provided a braking bar 28 having formed toward its one end an elongated slot 29 in which is fitted a protuberance 30 provided at a part of the inner surface of the recession 2 located close to the frame 23 so that said braking bar 28 is movable reciprocatively between the associated side of the frame 23 and the opposed peripheral part of the recession 2. A brake 31 is provided at an upright portion 32 erected from the end of the braking bar 28 positioned close to the frame 23. This brake 31 is pressed against a part of the reduction gears in the frame 23 to stop their rotation. Numeral 33 indicates a brake lever of which the lower end is joined to the top bent end 36 of an upright portion 35 extending from the end of the braking bar 28 passed through a hole 34 in the side wall of the recession 2 and projected into a space formed inside the peripheral wall of the base board 1, while the upper portion of said brake lever 33 extends through an elongated slot 37 formed in the upper peripheral surface of the base board 1 in accordance with the reciprocating direction of the braking bar 28 and has mounted atop thereof a grip 38. A supporting piece 39 is provided for supporting the brake lever 33 so as to allow its reciprocation in said elongated slot 37. At a middle part of the brake lever 33 is provided a stopper 40 in opposition to the side wall 7 of the rotary disc 4. This stopper is passed through a hole 41 formed in the side wall of the recession 2 and is engaged into one of the cutouts 8 formed in the side wall 7 of the rotary disc 4 to stop rotation of the rotary disc 4. Loaded to the brake lever 33 is a spring 43 adapted such that when the brake lever is moved to a limit of its reciprocative stroke, it is held at such limit position under the elastic force of said spring.

Now, the game board of this invention having the above-explicated arrangements is described from its operational aspect.

Figure 4:
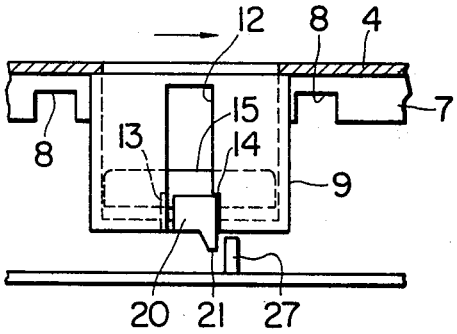
FIG. 4 is a side view of a pit in the game board, with a seat plate being shown locked at its lowermost position against the force of a spring.
Figure 5:
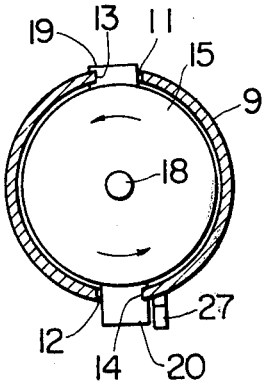
FIG. 5 is a view thereof.
Figure 6:
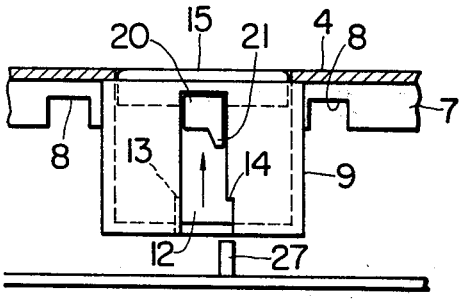
FIG. 6 is a view similar to FIG. 4 but showing the seat plate unlocked and having sprung up under the force of the spring.
Figure 7:
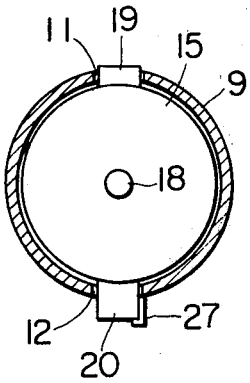
FIG. 7 is a plan view thereof.

In use of the game board, the bottom lobe 17 of each hop-up 16 is inserted into the hole 18 in each seat plate 15 and, by pressing the object 16, said seat plate 15 is lowered down to the bottom of a pit 9 as shown in FIG. 4, and then hold on the plaything 16 is released, whereby the seat plate 15 is turned in the direction of arrows in FIG. 5 by the pressing force of the coil spring 22 until the protuberances 19, 20 of said seat plate are brought into engagement with the corresponding stepped portions 13, 14 to lock the seat plate 15 at its lowermost position. Under this condition, the brake lever 33 is moved toward the periphery of the base board 1 by operating the grip 38 so as to separate the brake 29 from the reduction gear assembly in the frame 23 while moving the stopper 40 out of the hole 8 in the side wall 7 of the rotary disc 4, and then the grip 26 is turned to let the square shaft 24 accordingly turn in the direction where the spiral spring is wound up to accumulate the rotative force. When the rotative force has been sufficiently accumulated on the spiral spring, turning of the grip 26 is stopped to release winding of the spring, whereupon the spring is unwound and its accumulated rotative force is transmitted, while decelerated, to the driving gear 25 through the reduction gears to turn the driven gear 5 meshed therewith, thereby forcing the rotary disc 4 to rotate. In the course of rotation of the rotary disc 4, each contact piece 21 hits against a random protuberance 27 to move the associated engaging protuberances 19, 20 out of engagement with the corresponding stepped portions 13, 14 as shown in FIG. 7, so that the respective seat plates 15 are sprung up in irregular order at irregular time intervals as shown in FIG. 6 to let the respective objects 16 hop up above the rotary disc 4. So the players vie in capturing each popped-up object 16 with a scoop net 44 as shown in FIG. 1. The captured plaything are placed in the gutters 3 at both ends of the base board 1.

After all of the plaything 16 have been captured, the brake lever 33 is now moved toward the center of the base board 1, whereby the brake 31 is pressed against a part of the reduction gears to stop their turn while the stopper 40 is also moved into the hole 8 in the side wall 7 of the rotary disc 4 to stop its rotation.

The shape, number and positions of the pits 9 provided in the rotary disc 4 may be suitably changed, and also the pop-up plaything 16 may not necessary be model fishes but may take various other forms. Further, a motor may be employed for driving the rotary disc 4 instead of using a spring drive system used in the foregoing embodiment.

As described above, according to the game board described, the plaything hop up in irregular order at irregular time intervals from the pits in the rotary disc while it rotates, so that the players can have great amusement in vying with each other in capturing each popped-up object with good timing.

What is claimed is:

1. A game board comprising:

(a) a base board (1) defining a circular recession in its center with a bottom plate;

(b) a rotary disc (4) supported in said circular recession and a prime mover, said rotary disc being coupled thereto so as to be rotated by said prime mover;

(c) a plurality of irregularly arranged pits (9) in said rotary disc (4) set at random distances from the center of said rotary disc (4), side walls in said pits having a pair of vertical slots (11, 12) with upper and lower end parts each of which is provided with a lower engaging portion (13, 14) at the lower end part;

(d) a seat plate (15) with a spring (22) in each of said pits (9) and a popping plaything, said seat being so disposed therein as to support said plaything thereon such as a model fish, said plaything being vertically movable under the force of said pring (22);

(e) a pair of engaging lateral first protuberances (19, 20) extending outward from said seat plates (15) and disposed for vertical movement in said slots (11, 12) and also engaging said lower engaging portions (13, 14) when the seat plate is lowered against the force of said spring (22); and, (f) a plurality of second protuberances (27) on said bottom plate disposed on said bottom below said pits (9), said second protuberances (27) being arranged to hit against said engaging first protuberances (19, 20) when said first protuberances are in said lower engaging portions (13, 14) and moved with the rotation of the rotary disc (4), said first protuberances, when hit, move out of said lower engaging portions causing said seat plate (15) to shoot up under the force of said spring (22).

2. A game board as claimed in claim 1 wherein the prime mover is a motor.

* * * * *